US006463712B1

(12) United States Patent
Kolanko et al.

(10) Patent No.: US 6,463,712 B1
(45) Date of Patent: Oct. 15, 2002

(54) FLOOR TRUSS REPAIR BRACKET AND METHOD OF FABRICATION

(75) Inventors: Joseph Ted Kolanko, Morristown; Richard Stephen Batchelor, Norris; William Wayne Masengill, Jr., Morristown; Francis Carl Tindell, Knoxville, all of TN (US)

(73) Assignee: Fabricator Specialty, Inc., Morristown, TN (US)

( * ) Notice: Subject to any disclaimer, the term of this patent is extended or adjusted under 35 U.S.C. 154(b) by 0 days.

(21) Appl. No.: 09/680,635

(22) Filed: Oct. 6, 2000

(51) Int. Cl.[7] ..... E04C 3/30
(52) U.S. Cl. ..... 52/720.1; 52/702
(58) Field of Search ..... 52/712, 697, 690, 52/696; 248/300, 909

(56) References Cited

U.S. PATENT DOCUMENTS

| | | | | |
|---|---|---|---|---|
| 1,718,252 A | | 1/1929 | Putnam | |
| 4,653,242 A | | 3/1987 | Ezard | |
| 5,481,844 A | * | 1/1996 | Kajita | 52/702 |
| 5,544,459 A | | 8/1996 | Konger | |
| 5,819,494 A | | 10/1998 | Haisch | |
| 5,850,721 A | | 12/1998 | Martin | |

* cited by examiner

*Primary Examiner*—Carl D. Friedman
*Assistant Examiner*—Steve Varner
(74) *Attorney, Agent, or Firm*—Pitts & Brittian PC

(57) ABSTRACT

An improved bracket assembly that provides support and repair when connected to sides of a structural member installed in a support structure. The bracket assembly includes one or a pair of brackets that are composed of angle iron base portions having flanges thereon, and having opposed base end sections extending along a longitudinal axis from a centrally positioned and outwardly displaced mid-segment. The outwardly displaced mid-segment of each bracket is positioned adjacent to, and spans across, an open section of the structural member through which one or more conduits pass, thereby providing structural support while allowing passage of conduits through the structural member. The opposed base end sections include a plurality of equally spaced apart holes drilled therethrough, for connection of each bracket with wood screws to each structural member without requiring the pre-drilling of holes into each structural member. A method of fabrication of the support brackets having outwardly displaced mid-segments is further disclosed herein.

14 Claims, 6 Drawing Sheets

Figure 1:
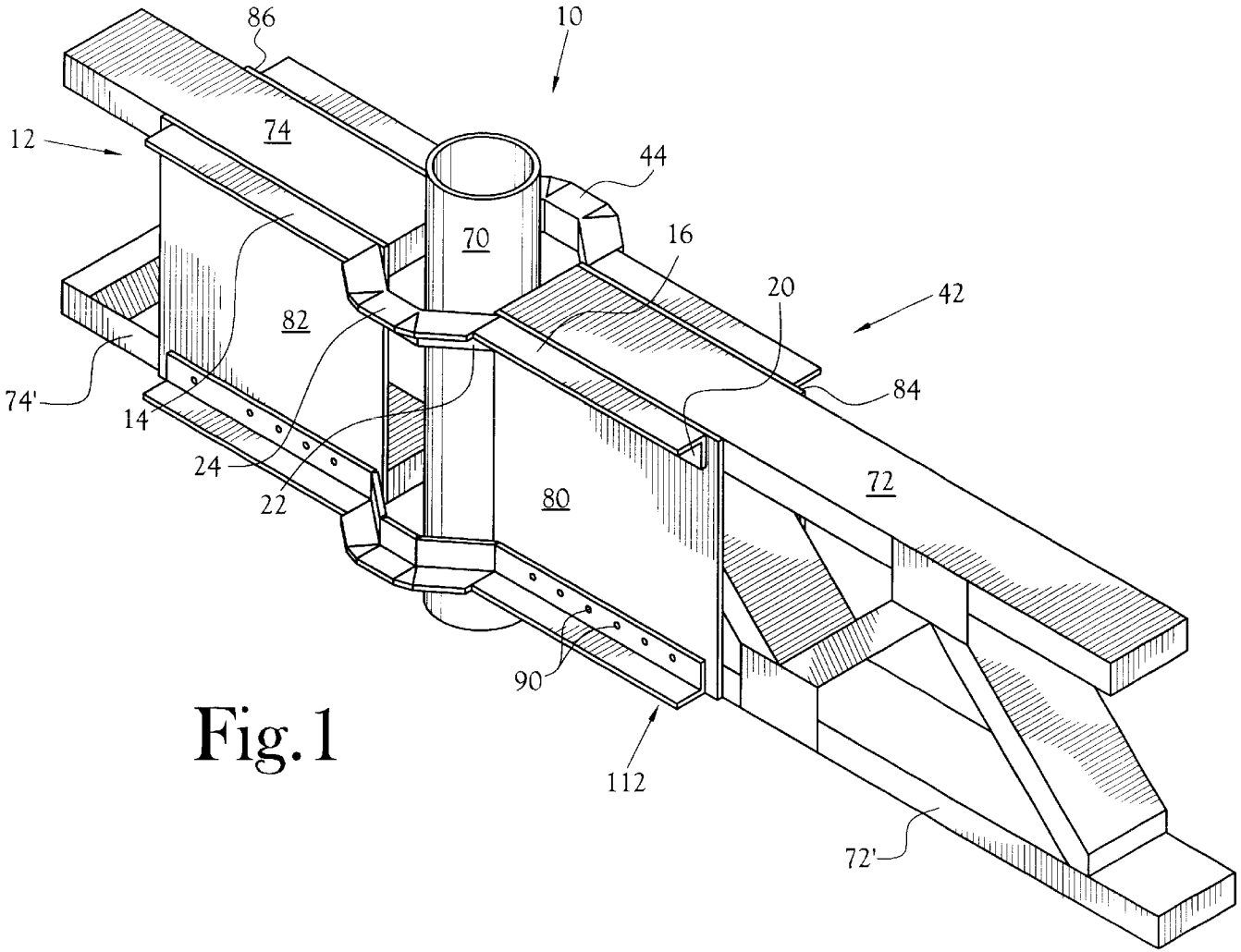

14
18
22
16
90
20

14
18
36
34
24
32
30
22
16
20

14
60
38
24
28
16

28

FLOOR TRUSS REPAIR BRACKET AND METHOD OF FABRICATION

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF INVENTION

1. Field of Invention

This invention relates to a repair bracket for a structural member. More specifically this invention relates to an improved repair bracket for connective support to a structural member and a method of fabrication of the repair bracket.

2. Description of the Related Art

Frame structures typically employ parallel wooden and/or metal beams called joists and trusses as floor and ceiling support members. The joists and trusses consist of sections of wood and/or metal, with braces, bridges, and/or connector brackets attached to provide additional support and rigidity for the floor and ceiling beams. The connector brackets can be attached to cross type braces to provide additional support and rigidity of the joists and trusses. An example of the prior art for truss connectors is U.S. Pat. No. 5,819,494, issued to Haisch on Oct. 13, 1998, which discloses a truss connector including first and second plates positioned on opposed sides of a truss, and a plurality of teeth extending inward from the plates, with the teeth imbedded into the truss when the plates are connected together by fasteners extending through the plate, truss, plate combination.

When connector brackets and cross type braces are utilized, no pre-manufactured channels or pathways are provided through the top chord and/or bottom chord of a truss (either tension and/or compression members), therefore when plumbing, electrical, and heating and cooling units are placed in preferred locations throughout a building, the conduits leading to the units must be run up through the ceiling plane and/or floor plane of the trusses. Typically, installers will cut holes or sections through the structural members such as connector plates, braces, top chord or bottom chord trusses, or joists to allow for passage of appropriate conduits. The cut holes or sections through the structural members must be repaired with additional supporting brackets and wood segments attached along the sides of the structural members, to restore the structural rigidity of the cut, and to repair the load-bearing capabilities of the structural members. There is a need for a repair bracket that repairs the structural rigidity of a weakened top chord and bottom chord of a truss or paired structural members, while providing for accommodation of wide-diameter channels through paired trusses and similar structural members.

The prior art devices do not provide brackets that can be applied on either face of a weakened top chord of a truss, and prior applications were for supporting a compression member of the structural member but not a tension member, while allowing for horizontal passage of conduits through the weakened top chord of a truss.

Therefore, it is an object of the present invention to provide a bracket that supports and repairs a weakened structural member to a preferred structural rigidity required for building support members.

It is another object of the present invention to provide a pair of brackets that are positionable on opposed sides of a cut pair of structural member to support and restore the integrity of the structural members.

It is a further object of the present invention to provide a pair of brackets that are attachable along opposite sides of a pair of structural members at weakened sections to provide support for passage through the structural members of a conduit while maintaining the structural integrity of the structural members.

It is a further object of the present invention to provide pairs of brackets that each include an outwardly displaced mid-portion, and are connectable with commonly available wood screws along the length dimension of a pair of structural members.

It is another object of the present invention to provide a method of fabrication of improved brackets utilized for strengthening of structural members.

BRIEF SUMMARY OF INVENTION

In accordance with the present invention, there is provided an improved bracket assembly that is connectable to sides of a structural member installed in a building support structure. The improved bracket assembly provides repair of a weakened portion of the structural member by connecting to one or more aligned structural members, to restore and maintain the load-bearing integrity of the structural member. The bracket assembly includes a pair of rigid brackets that are each connectable with a plurality of wood screws to opposed, outer sides of the structural member, to increase the rigidity of the structural member. Each bracket is composed of angle iron lengths having opposed end sections extending along a longitudinal axis, with a centrally positioned and outwardly displaced mid-segment. The outwardly displaced mid-segment of each bracket is positioned adjacent an opening or a section of the structural member through which one or more conduits pass, thereby providing structural support while allowing for passage of conduits through the structural member. The longitudinal length of the outwardly displaced mid-segment is sized to span and extend past an open gap of a truss, or across a gap between two aligned structural members.

Each bracket includes a plurality of equally spaced apart holes drilled along the base portion of each bracket, except for the outwardly displaced mid-segment. Cut-thread wood screw connectors are insertable into the holes for connection of each bracket to each respective outer side of the structural members. By providing each base portion with a plurality of equally spaced apart holes, and utilizing wood screws for connecting to each structural member, the bracket is connected without requiring the pre-drilling of holes into each structural member.

A method of fabrication shapes the outwardly displaced mid-segment by providing an angle iron shaped bracket and slicing cut slits into the flange mid-segment of each bracket, with each cut slit placed on opposite sides of a transverse center line of the flange mid-segment portion. A cutting step removes cut wedges from an outer pair of notches on opposite sides of the transverse center line of the mid-segment of each bracket. The flange mid-segment is bent outwards by applying a bending force against the back portion of the flange mid-segment, thereby shaping the outwardly displaced mid-segment having a preselected eccentricity outwards from the longitudinal length of the bracket. The cut wedges are bonded into each notch formed from a slit, with any protruding corners of the wedges cut off. Each bracket having outwardly displaced mid-segments shaped by the method of fabrication are positioned on opposite sides of a weakened portion of a structural member, thereby supporting and maintaining the structural integrity and rigidity of the structural member.

BRIEF DESCRIPTION OF SEVERAL VIEWS OF DRAWINGS

Figure 2A:
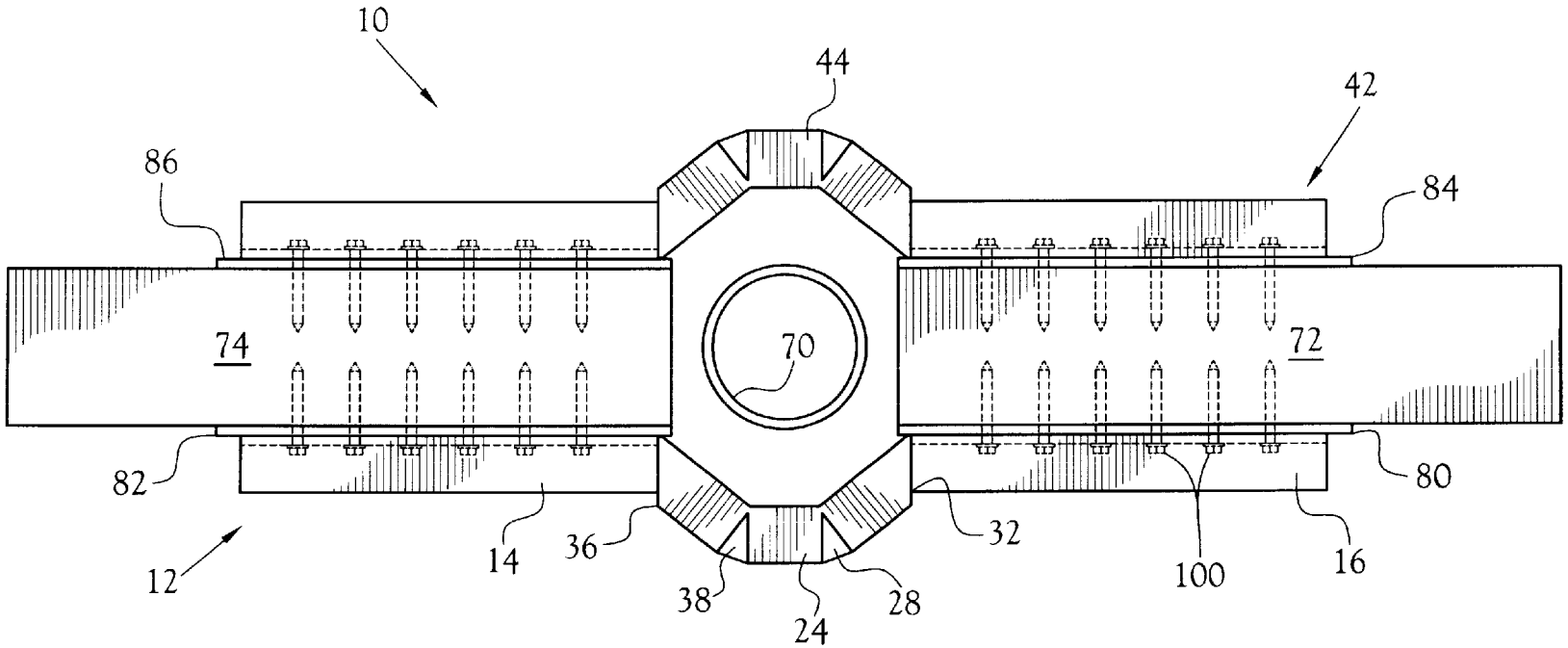
Figure 2B:
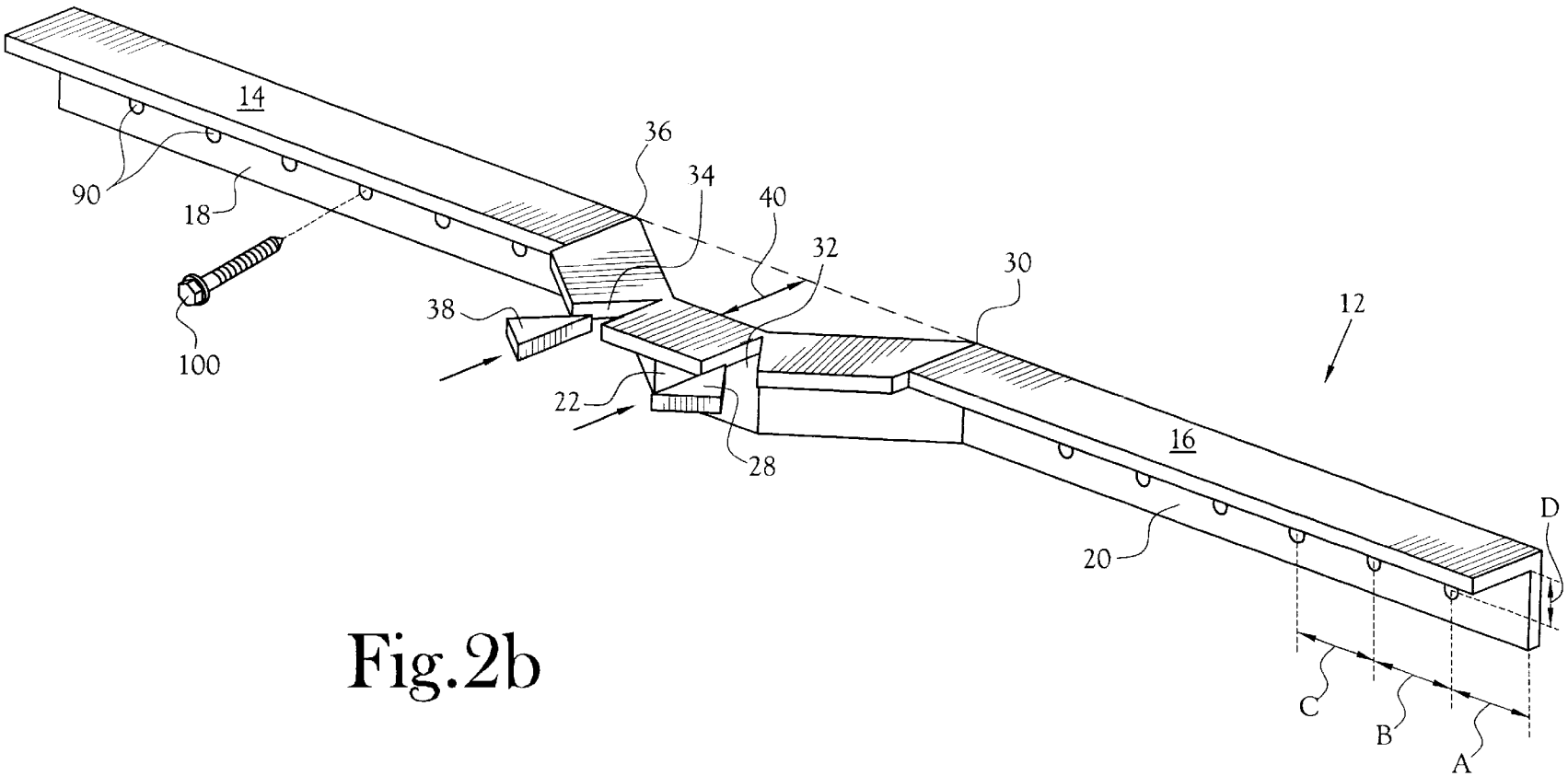
Figures 3A, 3B, 3C, 3D:
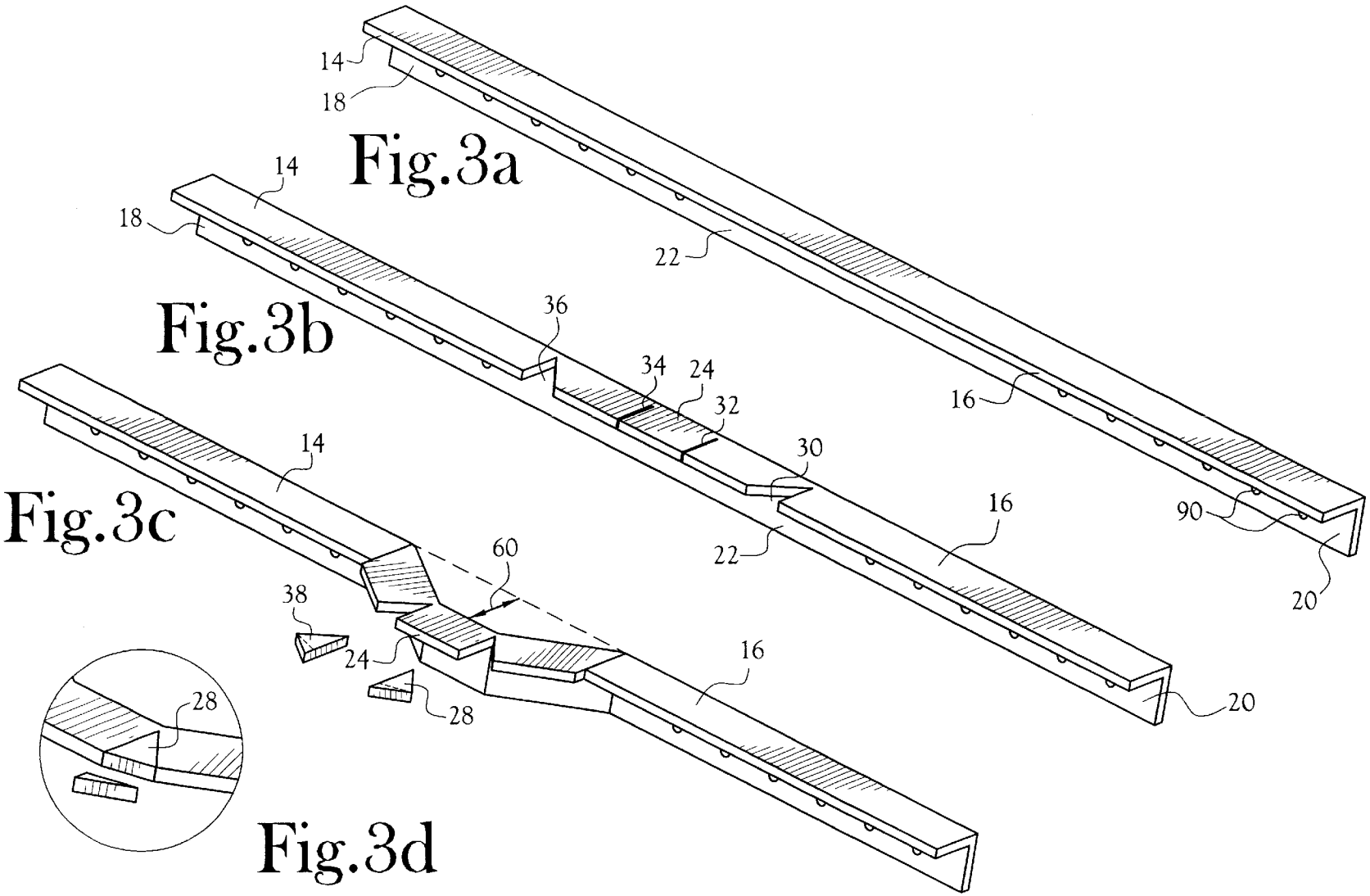
Figure 4A:
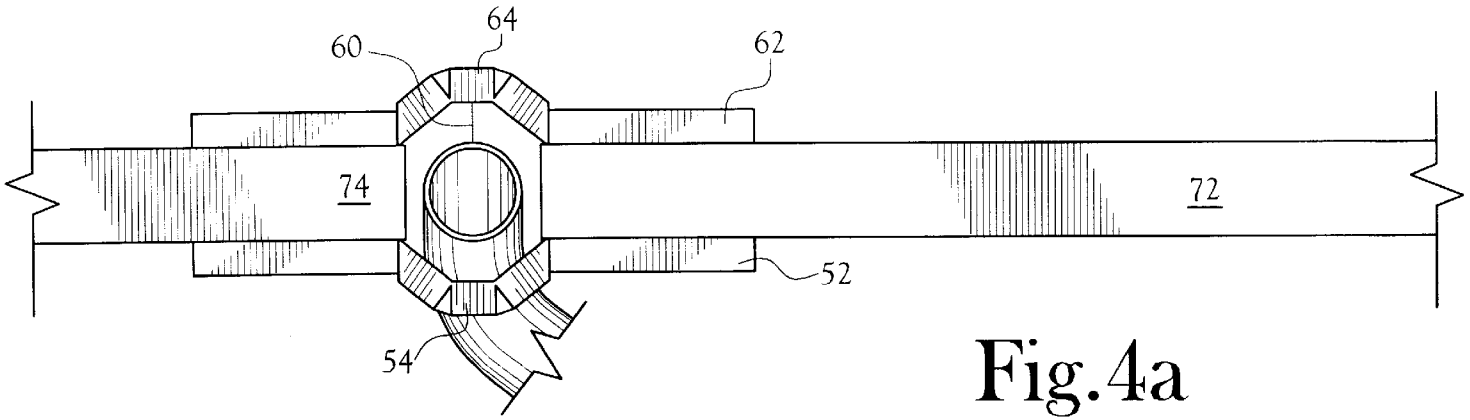
Figure 4B:
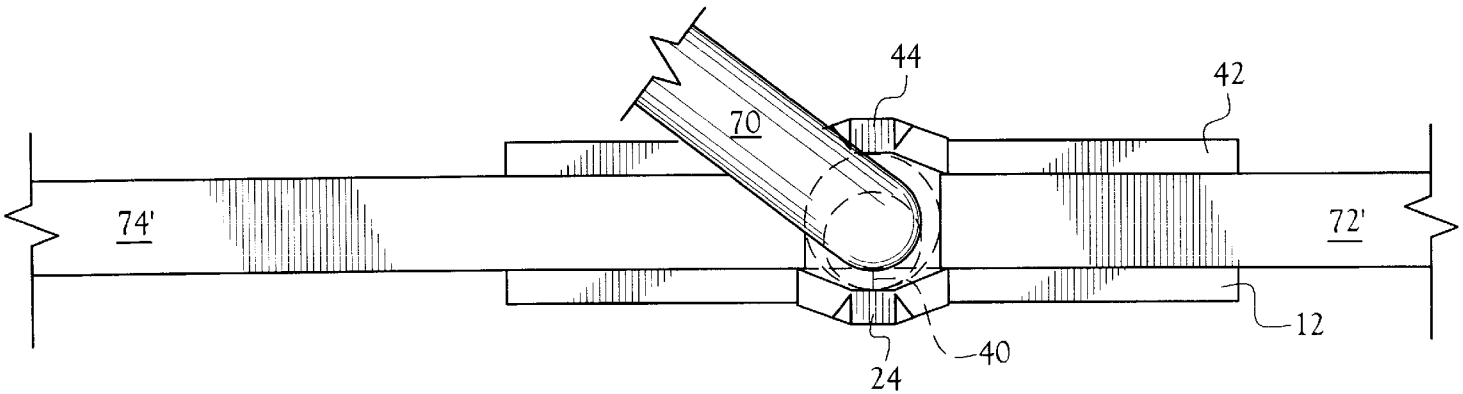
Figure 5:
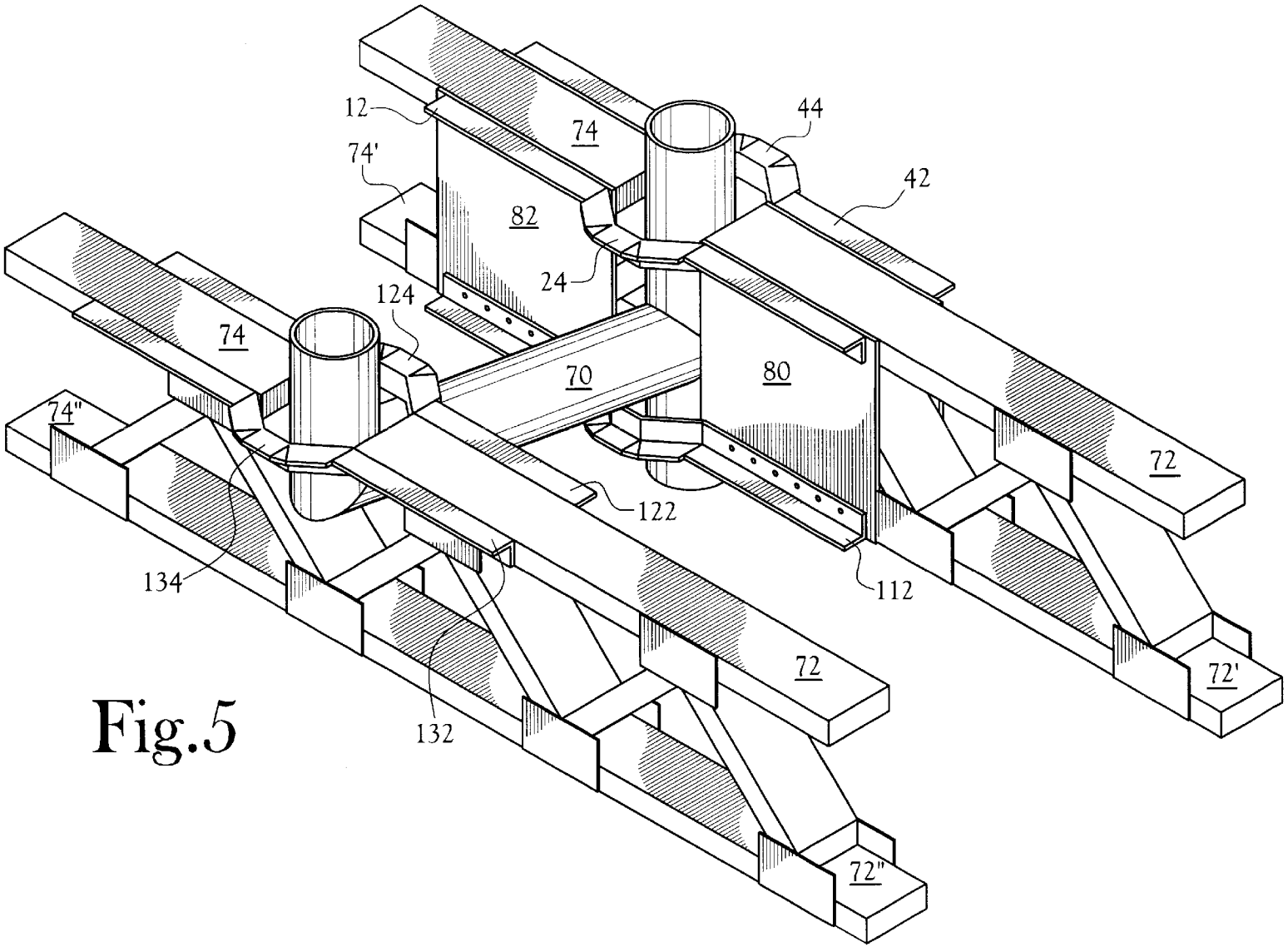

The above mentioned objects and advantages of the present invention are readily apparent from the description of the invention contained herein, and by reference to the claims, read together with the drawings in which:

FIG. 1 is a perspective side view of a plurality of pairs of brackets of the present invention installed along a structural member;

FIG. 2*a* is a top view of one embodiment of the installed bracket of FIG. 1;

FIG. 2*b* is a perspective side view of one bracket, illustrating the outwardly displaced flange mid-segment and the plurality of holes through the base portion of the bracket;

FIG. 3*a* is a perspective upper side view of the fabrication step of providing drilled connector holes through the base portion of the bracket;

FIG. 3*b* is a perspective upper side view of the fabrication step of cutting and notching the flange portion of the bracket; and FIG. 3*c* is a perspective side view of the fabrication step of bending and welding the mid-segment flange portion of the bracket;

FIG. 3*d* is an enlarged side view of the fabrication step of trimming the midsegment flange portion of the bracket;

FIGS. 4*a* and 4*b* are top views of an alternative embodiment illustrating a plurality of pairs of alternatively sized brackets oriented along respective structural members that are oriented parallel and proximate each other; and FIG. 5 is a perspective side view of an alternative embodiment illustrating a plurality of pairs of brackets oriented along respective adjacent structural members.

DETAILED DESCRIPTION OF THE INVENTION

In accordance with the present invention, there is provided an improved bracket assembly 10 incorporating various features as illustrated generally in FIGS. 1–5. The bracket assembly 10 provides strengthening and repair of an opening through a structural member, or provides connecting of two aligned structural members, while maintaining the integrity of the structural member and allowing for passage of conduits through any opening in a structural member, or for passage of conduits between two aligned and connected structural members.

FIG. 1 illustrates one embodiment of the bracket assembly 10 installed to enclose a conduit 70 and positioned between two pairs of aligned upper chords of structural members 72, 74 and aligned lower chords of structural members 72', 74'. The conduit 70 may include one or more of a plumbing conduit, an electrical conduit, heating and cooling conduits, or other conduits passing through or between sections of structural members. The structural members can include the floor plane and/or ceiling plane, connecting trusses, support joists, or other structural members known to those skilled in the art related to load bearing support beams utilized in construction of structures.

As shown in FIG. 1, one embodiment of the bracket assembly 10 includes a first pair of angle iron shaped brackets 12, 42 each having a base portion and a flange portion extending therefrom, with the base portion being connectable to two aligned structural members 72, 74 by a plurality of connectors. An alternative embodiment includes an additional second pair of angle iron shaped brackets 112, 142 (hidden from view but opposite 112) positioned a spaced apart distance from the first pair of brackets 12, 42 so as to connect onto a lower portion of two aligned structural members 72', 74' that are generally parallel with structural members 72, 74 (see FIG. 1). The angle iron shaped pairs of brackets 12, 42, and 112 illustrated in FIG. 1 (142 not shown), can be attached to sheets of plywood 80, 82, 84, 86 (see FIG. 1), or can be attached to sheets of oriented strand board (OSB) (not shown), which are connected by a plurality of connectors 100 (see FIG. 2*a* and 2*b*) to each respective structural member. The sheets of plywood or OSB are utilized to provide additional structural support when brackets are connected to structural members that have been cut to separate sections of the upper and lower chords to allow passage therethrough of one or more conduits.

The preferred connectors 100 utilized can include cut-thread wood screws known to those skilled in the art. One length of the cut-thread wood screws includes a 2½ inch length for the screws utilized to connect brackets 12, 42 and plywood 80, 82, 84, 86, or brackets and OSB, to respective structural members 72, 74, and 72', 74'. An alternative length of the cut-thread wood screws includes a 2 inch length for the wood screws utilized to connect brackets 122, 132, without plywood or OSB, to respective structural members 72, 74, and 72", 74" (see FIG. 5).

As illustrated in FIGS. 2*a* and 2*b*, the connectors 100 are inserted through a plurality of equally spaced apart holes 90 that are drilled through the base portion of each bracket. The holes 90 are spaced apart at about a 1½ inch width between hole centers, and about 1½ inch between each outer hole and the respective outer end sections 18, 20 of the bracket. As illustrated in FIG. 2*b*, distances A, B, and C are each about 1½ inches, providing a significant increase in connecting capacity over prior brackets by having aligned, opposed cut-thread wood screws inserted through brackets 12, 42, and into structural members 72, 74. By drilling holes 90 at equally spaced apart distances A, B, and C of about 1½ inches between each hole center, bracket is positionable with flanges 14, 16 oriented upwards (see FIG. 2*b*), or with flanges oriented downwards (see FIG. 1, bracket 112), providing for a broader range of installations against multiple configurations of structural members 72, 74 in either tension and/or compression applications.

The cut-thread wood screw connectors 100 are self-tapping and auger into structural members 72, 74. The ability to utilize cut-thread wood screws does not require the drilling of holes prior to connecting into the structural members for insertion of previously used connectors used such as lag screws or bolts. The plurality of holes 90 are aligned along each respective first end section 18 and second end section 20 of the base portion, with each hole 90 being aligned at a distance D of about one inch laterally out from the flange portions 14, 16 of each bracket. The about one inch lateral distance D from the flange portions 14, 16 provides for ease of insertion of cut-thread wood screw connectors 100 through bracket holes 90, and provides for sufficient working space for installers of brackets to maneuver a drill and drill bit while inserting screw connectors 100 without being impeded by each flange of brackets 12, 42, or by floor and/or ceiling surfaces. As illustrated in FIG. 2*a*, the wood screws are inserted through each bracket and into the structural members without the need for pre-drilled holes in the structural members. The wood screws are either aligned with opposed inserted wood screws, or offset (not shown) with opposed inserted wood screws. Prior uses of lag screws or bolts to secure brackets required an offset placement of lag screws or bolts into opposed sides of structural members.

As illustrated in FIGS. 1 and 2*a*, the pair of brackets 12, 42 are positioned against the structural members 72, 74 so that a central portion of each bracket is generally adjacent the conduit 70. Each bracket includes a first flange 14, and a second flange 16 that are separated by an outwardly displaced mid-segment 24 of the central portion of the flange that extends outwardly from the central base portion 22. The mid-segment 24 and base portion 22 are preferably positioned adjacent to the conduit 70. For two aligned structural members 72, 74 through which a conduit 70 extends, as shown in FIG. 2*a*, the outwardly displaced mid-segment 24 of the flange fully spans an open section that occurs between the aligned structural members 72, 74. A second bracket 42 having outwardly displaced mid-segment 44 is aligned generally parallel to first bracket 12 and on an opposite side of structural members 72, 74.

As illustrated in FIGS. 2*a* and 2*b*, the first flange 14 and second flange 16 extend outwardly from a junction with the respective first base portion 18 and second base portion 20. The base portions 18, 20 are connected against the respective structural members 72, 74, or are positioned against the respective sheets of plywood 80, 82, 84, 86, or OSB materials (not shown), for connection to the upper structural members 72, 74 and lower structural members 72', 74'. The outwardly displaced base portion 22, from which the outwardly displaced mid-segment 24 of the flange extends, is fabricated from a preselected length of metal having an angle iron shape and having a longitudinal length of between about 2.0 feet, to about 5.0 feet. The preferred lengths of angle iron brackets include a range of lengths of about a 2 feet 6 inch length (30 inches), to about a 4 feet length (48 inches). Alternative sized lengths of angle iron brackets having an outwardly displaced mid-segment 24 can be fabricated to connect to structural members that are not of standard dimensions. The widths and thicknesses of the angle iron brackets include a base portion width of about 1.5 inches, a flange width of about 1.5 inches, and a metal thickness of about 0.25 inch.

The outwardly displaced mid-segment 24 can be of a longitudinal length of between about 8.0 inches to about 12.0 inches, to provide adequate length to span open sections of about 6.0 inches to about 8.0 inches in length between structural members 72, 74. The displaced mid-segment 24 is fabricated by making cuts and notches into the flange of each bracket. The cuts and notches are placed at about four positions along the mid-segment portion of each bracket 12, 42 (see FIG. 3*b*). The notches include an outer pair of notches 30, 36 having the cut wedge portions 28, 38 removed. Each notch includes an outer opening from the outboard edge of the flange mid-segment 24, and each notch terminates proximate the inbounds junction of the mid-segment flange 24 and the mid-segment base portion 22. A pair of inner cuts 32, 34 along the width of the flange mid-segment 24 are centered an equal distance of about 1.0 inch on either side of the transverse center line of each flange mid-segment 24 of each bracket longitudinal length. The inner cuts include an outer opening from the outboard edge of the flange mid-segment 24, and each cut terminates proximate the inbounds junction of the mid-segment flange 24 with the mid-segment base portion 22. The inner cuts 32, 34 are separated by about a 2.0 inch distance, and the outer notches 30, 36 are separated by about a 3.0 inch distance from each respective inner cut 32, 34. The cut, removed wedge portions 28, 38 are of a wedge size of about 0.5 inch width at the widest portion of each wedge. The length of the wedge portions 28, 38 are of a length of less than about 1.5 inches.

Upon removal of wedge portions 28, 38, the back side 26 of the bracket 12 is bent outwards to form the outwardly displaced mid-segment 24. At outer notches 30, 36, each outer notch closes as the bracket flange surface is bent outwards, with resulting opening of inner notches along cuts 32, 34, as the outwardly displaced midsegment 24 is formed. Each cut wedge portion from each outer notch is bonded into each open inner notch of cuts 32, 34, to minimize the straightening of the outwardly displaced mid-segment 24 of each bracket, and to significantly increase the bracket rigidity when connected against structural members 72, 74, 72', 74' (see FIG. 1).

As illustrated in FIGS. 2*b*, 4*a* and 4*b*, the brackets include at least one outwardly displaced mid-segment 24, 44, 54, or 64 having one of at least two offset or eccentricity distances of about 1.0 inch offset 40 (see FIG. 2*b*), or about 2.0 inch offset 60 (see FIG. 4*a*). An alternative embodiment provides one or more brackets with each having two outwardly displaced mid-segments (not shown) along each bracket length.

FIGS. 4*a* and 4*b* illustrate an alternative embodiment that includes two different sized pairs of brackets 12, 42 (see FIG. 4*b*) and 52, 62 (see FIG. 4*a*) which are paired together and installed on separate structural members to provide strengthening and repairing of the structural members to obtain similar bending moments for the upper and lower structural members. A pair of brackets 52, 62 have dimensions of about thirty inches in length, and include about a 2.0 inch offset 60 eccentricity of the outwardly displaced mid-segments 54, 64, and are installed on upper structural members 72, 74. A pair of brackets 12, 42 have different lengths than brackets 52, 62 can be utilized in parallel alignment along lower structural members 72, 74. The brackets 12, 42 have dimensions of about forty-eight inches in length, and include about a 1.0 inch offset 40 eccentricity of the outwardly displaced mid-segments 24, 44. The differently sized pairs of brackets can provide the same bending moment for each pair of brackets when applied to each respective upper structural members 72, 74 and lower structural members 72', 74'.

FIG. 5 illustrates an alternative embodiment that includes a pair of upper brackets 122, 132 positioned and connected to one set of aligned structural members 72, 74 having a weakened section, without a similar pair of lower brackets connected to a lower set of aligned structural members 72", 74" which do not have a weakened section. Brackets 122, 132 include the general configuration of the bracket assembly 10 having outwardly displaced mid-segments 124, 134. Brackets 122, 132 do not include reinforcing sheets of plywood, and are aligned proximate to brackets 12, 42 connected to similar structural members 72, 74, 72', 74' that have weakened sections.

Alternatively, the bracket system 10 includes an embodiment (see FIG. 4*b*) that utilizes a pair of brackets 12, 42 having outwardly displaced mid-segments 24, 44 that are displaced at an offset 40 eccentricity of greater, or less, eccentricity (not shown), than the mid-segment 64 of bracket 62. At least one bracket having one offset 40 eccentricity, matched with at least one bracket having a different offset 60 eccentricity, or a third alternative offset eccentricity (not shown), allows accommodation of a conduit 70 that is offset and oriented close to one side of one of aligned structural members 72', 74' (seen as phantom circular lines in FIG. 4*b*).

Method of Fabrication

A method of fabrication of the angle iron shaped bracket 12 includes the following steps, as illustrated generally in FIGS. 3*a*, 3*b*, 3*c*, and 3*d*. A first step includes providing a properly sized length of angle iron shaped bracket 12 having a continuous flange portion that is generally oriented at right angles to a base portion. A boring step provides a plurality of equally spaced apart holes 90 drilled through the base portion of bracket 12. The boring step drills equally spaced apart holes at about 1½ inch apart from each hole center, and positions each hole about 1.0 inch outwards from the flange portion, and along a length-wise axis of the base portions 18 and 20.

A cutting step cuts two outer notches 30, 36, and two inner slits 32, 34 along the flange portion of angle iron bracket 12. The slits are the approximate width of a kerf cut made by a sawing device known to those skilled in the art of cutting slits in metal. The notches and slits are cut at predetermined distances from the middle of the bracket flange. The separation between the center lines of each open slit 32, 34 is about two inches, with each inner slit 32, 34 spaced about one inch from the transverse center line of the flange mid-segment 24.

A bending step applies an adequate bending force against the back side 26 of the junction of the flange mid-segment 24 and the mid-portion base, therefore displacing outwardly the mid-segment 24 of the flange of the bracket 12 outwards from the back side 26 of the bracket 12, to create the outwardly displaced base portion 22 and the outwardly displaced mid-segment 24. As the outer notches 30, 36 close during bending, the inner notches form as the inner slits 32, 34 open, thereby forming the outwardly displaced mid-segment 24. The inner notches can have respective wedge 28, 38 interposed and welded into the respective inner notches 32, 34 to minimize the straightening of the outwardly displaced mid-segment 24 of each bracket after installation against the respective outer sides of the structural members.

An assembly step includes inserting the wedges of material 28, 38 that are cut from the respective outer notches 30, 36, into opened notches 32, 34 after the bending step. A welding step connects wedge 28 into notch 32, and connects wedge 38 into notch 34 to minimize the straightening or realigning of the flange sections 14, 24, 16, to minimize the lateral movement of outwardly displaced mid-segment 24, and to strengthen the rigidity of the bent and welded bracket 12. A trimming step, either before or after the assembly step, includes trimming corners of wedges 28, 38 that extend from the outboard edge perimeter of the flange outwardly displaced midsegment 24, as illustrated in the FIG. 3*d*.

Those skilled in the art will recognize advantages of the present invention including a rigid bracket assembly that is connectable along the sides of a variety of configurations of structural members installed in a building support structure. The bracket assembly provides repair of a weakened portion of the structural member by connecting to one or more aligned structural members, to restore and maintain the load-bearing integrity of the structural member. The outwardly displaced mid-segment of each bracket is positioned adjacent an opening or a section of the structural member through which one or more conduits pass, thereby providing structural support while allowing for passage of conduits through, or between the structural members. The length of the outwardly displaced mid-segment is sized to span and extend across a multitude of widths of open sections between structural members. The bracket can be positioned with the flange portion oriented upwards, or the flange portion oriented downwards due to the equally spaced apart holes drilled through the base portion of the bracket. Different configured brackets are combined to support different sized structural members and to accommodate different sized conduits extended through the structural members.

While a preferred embodiment is shown and described, it will be understood it is not intended to limit the disclosure of the invention, but rather it is intended to cover all modifications and alternative apparatus embodiments, systems and methods of operating falling within the spirit and scope of the invention as defined in the appended claims.

What is claimed is:

1. A bracket for supporting and repairing a structural member having a weakened section along a length of the structural member, comprising:

a rigid bracket of a preselected length, said bracket having an angle iron shaped cross-section, said bracket having a base portion and a flange extending therefrom, said base portion and flange each having first and second end sections being generally aligned in a length dimension, said base portion being positioned along the length of the structural member; and a mid-segment of said bracket displaced outwardly non-linear of said length dimension from said base portion of said first and second end sections, said outwardly displaced mid-segment includes a mid-segment base portion and a mid-segment flange having a width extended outwardly from a junction between said mid-segment base portion and said mid-segment flange, said mid-segment flange having an outboard edge, said mid-segment flange further including:

a first cut and a second cut laterally through said width extended of said mid-segment flange, each cut opening outwardly of said outboard edge of said mid-segment flange, each cut inwardly terminated proximate said junction, said first cut and second cut positioned a preselected length on opposite sides of a transverse center of said mid-segment flange; and a first notch and a second notch cut through said width extended of said mid-segment flange, each notch being generally triangular and opening outwardly of said outboard edge, each notch inwardly terminated proximate said junction, said first notch positioned at a first preselected distance greater than said preselected length of said first cut from said transverse center, said second notch positioned at a preselected distance greater than said preselected length of said second cut from said transverse center of said mid-segment flange;

whereby said base portion of said first and second end sections are connected proximate to, and disposed along the length of the structural member with said outwardly displaced mid-segment of said bracket extended outwards from, and generally centered across from the weakened section of the structural member.

2. The bracket of claim 1, wherein said first and second end sections of said base portion includes a plurality of spaced apart holes therethrough, said holes spaced apart periodically over said length dimension of said first and second end sections, said holes aligned along a longitudinal axis of said first and second end sections of said base portion of said bracket.

3. A bracket for supporting and repairing a structural member including aligned structural members having a weakened gap section along a length of the aligned structural members, comprising:

a rigid bracket of a preselected length, said bracket having an angle iron shaped cross-section, said bracket having a base portion and a flange extending therefrom, said base portion and flange each having first and second end sections being generally aligned in a length dimension, said base portion being positioned along the length of the aligned structural members; and a mid-segment of said bracket displaced outwardly non-linear of said length dimension from said base portion of said first and second end sections;

whereby said base portion of said first and second end sections are connected proximate to, and along the length of aligned structural members with said outwardly displaced mid-segment extended outwards from, and generally centered across from the weakened gap section of the aligned structural members;

said displaced mid-segment includes a mid-segment base portion and a mid-segment flange having a width extended outwardly from a junction between said mid-segment base portion and said mid-segment flange, said mid-segment flange having an outboard edge, said mid-segment flange further including:

a first cut and a second cut laterally through said width extended of said mid-segment flange, each cut opening outwardly of said outboard edge of said mid-segment flange, each cut inwardly terminated proximate said junction, said first cut and second cut positioned a preselected length on opposite sides of a transverse center of said mid-segment flange; and a first notch and a second notch cut through said width extended of said mid-segment flange, each notch being generally triangular and opening outwardly of said outboard edge, each notch inwardly terminated proximate said junction, said first notch positioned at a first preselected distance greater than said preselected length of said first cut from said transverse center, said second notch positioned at a preselected distance greater than said preselected length of said second cut from said transverse center of said mid-segment flange.

4. The bracket of claim 3, wherein said preselected length of said first cut from said transverse center is equivalent to said preselected length of said second cut on opposite sides of said transverse center of said mid-segment flange.

5. The bracket of claim 4, wherein said preselected distance is the same for each notch opening on opposite sides of said transverse center of said mid-segment flange.

6. The bracket of claim 3, wherein said mid-segment of said bracket is displaced outwardly from said base portion by an offset distance of about 1.0 inch from said first and second end sections being generally aligned in a length dimension.

7. The bracket of claim 3, wherein said mid-segment of said bracket is displaced outwardly from said base portion by an offset distance of about 2.0 inch from said first and second end sections being generally aligned in a length dimension.

8. The bracket of claim 3, wherein said preselected length of said bracket is selected from a range of lengths of about 30 inches to about 48 inches.

9. A pair of brackets for strengthening and repairing aligned structural members including a weakened section having a conduit therethrough, said weakened section disposed along a length of the aligned structural members, comprising:

a pair of rigid brackets of a preselected length, said brackets each having an angle iron shaped cross-section, said brackets having a base portion and a flange extending therefrom, each of said flange and base portion each having first and second end sections being generally aligned in a length dimension, said base portion being positioned along the length of the aligned structural members; and a mid-segment of each bracket displaced outwardly non-linear of said length dimension from each of said base portions of said first and second end sections of respective brackets;

whereby said base portion of said first and second ends of each respective bracket are connected proximate to and along the length of the aligned structural members with the outwardly displaced mid-segment extended outwards from, and generally centered across from the weakened section having the conduit therethrough of the aligned structural members;

said displaced mid-segment of each bracket includes a mid-segment base portion and a mid-segment flange having a width extended outwardly from a junction with said mid-segment base portion, each mid-segment flange further including:

a first cut and a second cut laterally through said width extended of each mid-segment flange, each cut opening outwardly of said outboard edge of said mid-segment flange, each cut inwardly terminated proximate said junction, said first cut and said second cut positioned a preselected length on opposite sides of said transverse center of said mid-segment flange; and a first notch and a second notch cut through said width extended of each of said mid-segment flange, each notch being generally triangular and opening outwardly of said outboard edge, each notch inwardly terminated proximate said junction, said first notch positioned at a second preselected distance greater than said preselected length of said first cut from said transverse center, said second notch positioned opposite said transverse center than said first notch and at a third preselected distance greater than said preselected length of said second cut from said transverse center of said mid-segment flange.

10. The brackets of claim 9, wherein said preselected length is substantially the same for each cut on opposite sides of said transverse center of said mid-segment flange.

11. The brackets of claim 9, wherein said first and second preselected distance is the same for each notch on opposite sides of said transverse center of said mid-segment flange.

12. The brackets of claim 9, wherein said mid-segment of said bracket is displaced outwardly from said base portion by an offset distance of about 1.0 inch from said first and second end sections being generally aligned in a length dimension.

13. The brackets of claim 9, wherein said mid-segment of said bracket is displaced outwardly from said base portion by an offset distance of about 2.0 inch from said first and second end sections being generally aligned in a length dimension.

14. The brackets of claim 9, wherein said first and second end sections of said respective base portions include a plurality of holes therethrough, said plurality of holes spaced apart periodically over the length dimension of said first and second end sections, said plurality of holes aligned along a length axis of said first and second end sections of said base portion of each bracket.

* * * * *